US010208738B2

(12) United States Patent
Suda et al.

(10) Patent No.: US 10,208,738 B2
(45) Date of Patent: Feb. 19, 2019

(54) FUEL SUPPLY SYSTEM

(71) Applicants: KEIHIN CORPORATION, Shinjuku-ku, Tokyo (JP); EAGLE INDUSTRY CO., LTD., Minato-ku, Tokyo (JP)

(72) Inventors: Kenji Suda, Miyagi (JP); Toshiaki Iwa, Tokyo (JP); Yoshihiro Ogawa, Tokyo (JP); Naoki Murata, Tokyo (JP)

(73) Assignees: Eagle Industry Co., Ltd., Tokyo (JP); Kelhin Corporation, Tokyo (JP)

( * ) Notice: Subject to any disclaimer, the term of this patent is extended or adjusted under 35 U.S.C. 154(b) by 217 days.

(21) Appl. No.: 15/051,959

(22) Filed: Feb. 24, 2016

(65) Prior Publication Data

US 2016/0258427 A1 Sep. 8, 2016

(30) Foreign Application Priority Data

Mar. 6, 2015 (JP) ..... 2015-045047

(51) Int. Cl.

| | |
|---|---|
| ***F04B 11/00*** | (2006.01) |
| ***F04B 19/22*** | (2006.01) |
| ***F04B 53/14*** | (2006.01) |
| ***F04B 53/16*** | (2006.01) |
| ***F04B 53/10*** | (2006.01) |
| ***F04B 53/00*** | (2006.01) |

(Continued)

(52) U.S. Cl.

CPC ..... *F04B 11/0091* (2013.01); *F02M 55/04* (2013.01); *F02M 59/48* (2013.01); *F04B 11/0033* (2013.01); *F04B 19/22* (2013.01); *F04B 53/001* (2013.01); *F04B 53/10* (2013.01); *F04B 53/14* (2013.01); *F04B 53/16* (2013.01)

(58) Field of Classification Search

CPC ... F04B 11/0091; F04B 11/00; F04B 11/0008; F04B 11/0016; F04B 11/0033; F04B 39/0027; F04B 39/0033; F04B 39/005; F04B 39/0055; F04B 39/0061; F04B 53/001; F04B 53/002; F02M 55/04; F02M 37/0041; F02M 59/025; F02M 59/027; F02M 2200/31; F02M 2200/315

USPC ..... 417/540

See application file for complete search history.

(56) References Cited

U.S. PATENT DOCUMENTS

2015/0017041 A1* 1/2015 Usui ..... F02M 55/04 417/540

FOREIGN PATENT DOCUMENTS

JP 2004-138071 A 5/2004
JP 4478431 B2 * 6/2010 ..... F02M 37/0041

OTHER PUBLICATIONS

Author: Merriam-Webster Title: Bellows Date accessed (mm/dd/yyyy): Dec. 6, 2017 Link: https://www.merriam-webster.com/dictionary/bellows.*

* cited by examiner

*Primary Examiner* — Alexander B Comley
*Assistant Examiner* — Chirag Jariwala
(74) *Attorney, Agent, or Firm* — Carrier Blackman & Associates, P.C.; William D. Blackman; Joseph P. Carrier

(57) ABSTRACT

The present invention provides a fuel supply system having improved assembly and pulsation reducing efficiency. A housing (20) of a fuel supply system (1) is formed by joining a first housing member (20*a*) forming one end side of a tubular chamber (23) in the direction of the backward and forward movement of a plunger (10) and a second housing member (20*b*) forming the other end side. A pulsation (Continued)

reducing mechanism (60) includes a tubular bellows damper (61) housed in the tubular chamber (23).

8 Claims, 3 Drawing Sheets

(51) Int. Cl.
*F02M 55/04* (2006.01)
*F02M 59/48* (2006.01)

FUEL SUPPLY SYSTEM

BACKGROUND OF THE INVENTION

Field of the Invention

The present invention relates to a fuel supply system for pressurizing fuel that has flowed inside and supplying the pressurized fuel to an internal combustion engine, and in particular, to a fuel supply system including a pulsation reducing mechanism that reduces pressure pulsation.

Description of the Related Art

A fuel supply system has conventionally been known that moves the proximal end of a plunger into and back from a pressuring chamber formed inside a housing to pressurize fuel having flowed in the pressuring chamber, and supplies the pressurized fuel (hereinafter, referred to as "high pressure fuel") to an internal combustion engine such as engines (e.g., see Japanese Patent Laid-Open No. 2004-138071).

Such a fuel supply system, which pressurizes fuel by the backward and forward movement of the plunger, causes pulsation in the fuel, and the pulsation may propagate to a channel area having pressure lower than the pressure of the pressuring chamber, resulting in damage to the lower pressure area of the channel. Thus, providing a pulsation damper mechanism for reducing the pulsation has also been known.

For example, the fuel supply system described in Patent Laid-Open No. 2004-138071 provides a tubular space (hereinafter, referred to as "tubular chamber") around the pressuring chamber, and the edge of a metal thin layer is welded on the wall surface of the tubular chamber as a diaphragm. The volume of the space between the diaphragm and the wall surface of the tubular chamber is varied to reduce pulsation.

However, the tubular chamber of the conventional fuel supply system has a small internal space, and thus the work of providing the diaphragm by welding the metal thin layer onto the wall surface of the tubular chamber is troublesome, resulting in a problem of deteriorated assembly.

Furthermore, the small internal space of the tubular chamber in the conventional fuel supply system causes the positioning of the diaphragm to be formed (i.e., determining the arrangement position of the pulsation reducing mechanism) to be difficult, and thus the arrangement position of the pulsation reducing mechanism may shift from the position that allows pulsation occurring by the plunger reciprocating motion to be sufficiently reduced. As a result, the pulsation reducing function may be insufficient.

The present invention has been made in view of such circumstances. An object of the present invention is to provide a fuel supply system that allows improved assembly and pulsation reducing efficiency.

SUMMARY OF THE INVENTION

To this end, the fuel supply system of the present invention includes a plunger, a housing with the plunger inserted therein so as to move backward and forward, and a pulsation reducing mechanism arranged in the housing. The housing includes a tubular chamber provided so as to extend in a direction of the backward and forward movement of the plunger and surround an axis line of the plunger, and a pressuring chamber communicating with the tubular chamber, and one end portion of the plunger moves backward from and forward into the pressuring chamber. The housing is formed by joining, at least, a first housing member forming one end side of the tubular chamber in the direction of the backward and forward movement of the plunger and a second housing member forming an other end side of the tubular chamber. The pulsation reducing mechanism includes a tubular damper housed in the tubular chamber.

In the present invention, the housing is formed by joining, at least, the first housing member forming one end side of the tubular chamber in the direction of the backward and forward movement of the plunger and the second housing member forming the other part of the tubular chamber. For this reason, before the formation of the housing, the pulsation reducing mechanism can easily be arranged in the tubular chamber in a shape divided into the first housing member and the second housing member.

In the present invention, the tubular damper is provided as a pulsation reducing mechanism in the tubular chamber provided so as to surround the axis line of the plunger in the housing. For this reason, positioning of the damper (i.e., arranging the damper at the position that allows a sufficient reduction in pulsation caused by the reciprocating motion of the plunger) can be reliably performed. As a result, the damper can sufficiently carry out the pulsation reducing function.

Therefore, the present invention allows the fuel supply system to be easily assembled and the pulsation reducing efficiency of the assembled fuel supply system to be improved.

In the fuel supply system of the present invention, preferably, the pulsation reducing mechanism includes a fixing member for fixing the damper to the first housing member or the second housing member, the fixing member includes a tubular section, and a ring-like (flange) section extending radially from an end of the tubular section, the damper being joined to the ring-like section, and the tubular section fits the wall surface of the tubular chamber.

Such a structure allows the damper to be fixed to the wall surface of the tubular chamber via the fixing member. As a result, the damper can be more easily positioned while avoiding a misalignment of the axes of the tubular chamber and the damper.

In the fuel supply system of the present invention, the damper may be a bellows damper expanding/contracting in the direction of the backward and forward movement of the plunger.

In the fuel supply system of the present invention, preferably, the housing includes a fuel channel providing communication between the pressuring chamber and the tubular chamber, and the fuel channel is formed to extend in a direction along a direction of an expanding/contracting of the damper.

If the fuel channel extends in the direction along the direction of the expanding/contracting of the damper in this manner, the damper can also reduce pulsation caused when fuel flows from the pressuring chamber to the tubular chamber. As a result, the pulsation reducing efficiency can be further improved.

BRIEF DESCRIPTION OF THE DRAWINGS

FIG. 3A illustrates a state before the bellows damper is press fit, and FIG. 3B illustrates a state the bellows damper is press fit.

DETAILED DESCRIPTION OF THE PREFERRED EMBODIMENTS

An embodiment of a fuel supply system according to the present invention will now be described with reference to the drawings.

Figure 1:
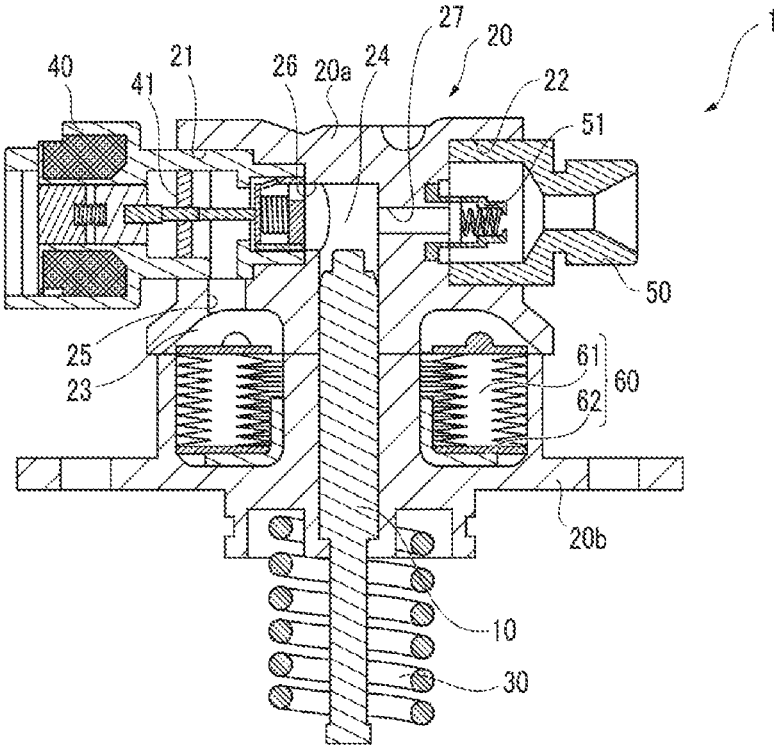
FIG. 1 is a cross-sectional side view of a fuel supply system according to an embodiment of the present invention.

As illustrated in FIG. 1, a fuel supply system 1 includes a plunger 10, and a housing 20 in which the plunger 10 can move backward and forward.

The plunger 10 moves in conjunction with a movement of a cam (not shown) arranged under the housing 20. The plunger 10 is also biased by a spring 30 provided under the housing 20 toward the cam via a tappet mechanism (not shown). The plunger 10 reciprocates along its backward and forward movement direction (extending direction) by the force from the rotational motion by the cam and the biasing force from the spring 30.

The housing 20 also includes a tubular fuel gallery 23 (tubular chamber) having a longitudinal axis provided so as to extend in the direction of the backward and forward movement (extending direction) of the plunger 10 and surround the axis line of the plunger, and a pressuring chamber 24 formed at the inner periphery side of the fuel gallery 23 so as to be situated, as viewed from the axis direction of the plunger 10, at a position that aligns with, and overlaps the hollow in which the plunger 10 slides.

The housing 20 also includes a tubular fuel gallery 23 (tubular chamber) provided so as to extend in the direction of the backward and forward movement (extending direction) of the plunger 10 and surround the axis line of the plunger, and a pressuring chamber 24 formed at the inner periphery side of the fuel gallery 23 so as to, as viewed from the axis direction of the plunger 10, at a position that overlaps the hollow in which the plunger 10 slides.

The fuel gallery 23 communicates through a first communication path 25 (fuel channel) with the pressuring chamber 24 via the inflow amount restrictor 40 which is fitted in the inlet-side receiving hollow 21. A pulsation reducing mechanism 60 is arranged inside the fuel gallery 23 encompasses.

The pressuring chamber 24 is formed at one end side of the plunger 10. The proximal end of the plunger 10 can move backward from and forward into the pressuring chamber 24. The pressuring chamber 24 also communicates, via a third communication path 27, with the internal space of the discharging member 50 fitted in the outlet-side receiving hollow 22.

The housing 20, which has such an internal structure, is formed by joining a first housing member 20*a* forming one end side (upper side in FIG. 1) of the fuel gallery 23 in the direction of the backward and forward movement of the plunger 10 to a second housing member 20*b* forming the other end side (lower side in FIG. 1). Examples of the way of joining include welding or the like.

For that reason, in the fuel supply system 1, before the formation of the housing 20, the pulsation reducing mechanism 60 can easily be installed in the fuel gallery 23 which is in a form separated to the first housing member 20*a* and the second housing member 20*b*.

In addition, since the fuel gallery 23 and the hollow in which the plunger 10 slides are formed at a position which overlap each other as viewed from the axis direction of the plunger 10, the entire fuel supply system 1 can be compactly formed.

A fuel flow inside the housing 20 will now be described.

Fuel pressure-fed from a low-pressure fuel pump (not shown) coupled to the housing 20 first flows into the fuel gallery 23. The fuel flows through the first communication path 25 into the internal space of the inflow amount restrictor 40 received in the inlet-side receiving hollow 21 of the housing 20.

The internal space of the inflow amount restrictor 40 is installed with an electromagnetic valve 41. The electromagnetic valve 41 controls the amount of fuel flowing from the internal space of the inflow amount restrictor 40 to the pressuring chamber 24 via a second communication path 26.

The fuel, which has flowed in the pressuring chamber 24, is pressurized into high pressure fuel by the plunger 10 moving backward and forward in the pressuring chamber 24.

The high pressure fuel flows from the pressuring chamber 24, via the third communication path 27, into the internal space of the discharging member 50 received in the outlet-side receiving hollow 22. The high pressure fuel is then pressure-fed to the outside of the housing 20 (i.e., to a fuel accumulator coupled to the housing 20 (not shown)).

The internal space of the discharging member 50 is provided with a check valve 51. For this reason, in a case where the pressure of the high pressure fuel is lower than a defined fuel pressure, the high pressure fuel is not pressure-fed to the fuel accumulator (not shown).

In this manner, the fuel supply system 1 uses the reciprocating motion of the plunger 10 to apply pressure to the fuel in the pressuring chamber 24 so as to be high pressure fuel. More specifically, pressure is applied to the fuel when the proximal end of the plunger 10 moves in the inserting direction into the pressuring chamber 24.

The fuel in the pressuring chamber 24 may have pulsation caused by the influence of reciprocating movement of the plunger 10 or the like. Pulsation caused in the fuel may propagate to a channel in the low pressure side (downstream side) compared to the pressuring chamber 24, resulting in damage to the channel in the lower pressure side.

To reduce such pulsation, the fuel supply system 1 of the present embodiment has the pulsation reducing mechanism 60 inside the fuel gallery 23, which is at the low pressure side of the pressuring chamber 24 and communicates with the pressuring chamber 24.

Figure 2:
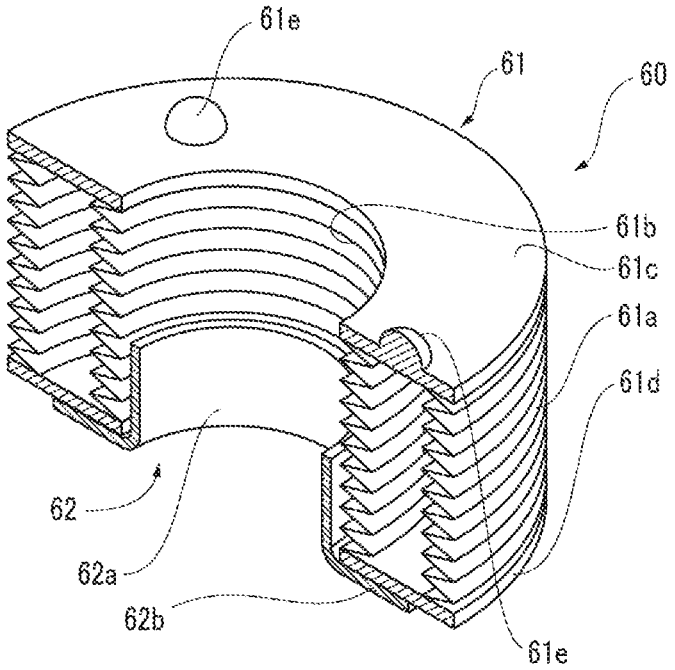
FIG. 2 is a cross-sectional perspective view of a bellows damper and a sleeve of the fuel supply system in FIG. 1.

As illustrated in FIG. 2, the pulsation reducing mechanism 60 includes a bellows damper 61, and a sleeve 62 (fixing member) for fixing the bellows damper 61 to the second housing member 20*b*.

The bellows damper 61 includes a tubular outer peripheral portion 61*a* formed of an accordion metal thin layer, a tubular inner peripheral portion 61*b* provided on the inner periphery side of the outer peripheral portion 61*a* and formed of an accordion metal thin layer, a ring-like first end portion 61*c* provided on one end side of the outer peripheral portion 61*a* and the inner peripheral portion 61*b*, and a ring-like second end 61*d* provided on the other end side of the outer peripheral portion 61*a* and the inner peripheral portion 61*b*.

That is, the bellows damper 61 is made as a tubular member having a space between a pair of accordion side walls, and expandable and contractible in the axis direction.

The bellows damper 61 varies the volume of the internal space to reduce pulsation in the liquid surrounding the bellows damper 61 (i.e., the fuel existing in a space communicating with the pressuring chamber 24).

In the fuel supply system 1, the expanding/contracting direction of the bellows damper 61 coincides with the direction along the backward and forward movement direction of the plunger 10 (the direction of moving backward and forward) (i.e., the direction of fuel pulsation caused by the reciprocating motion of the plunger 10). Thus, the pulsation is efficiently reduced by the bellows damper 61.

The first end portion 61*c*, which is the upper end side of the bellows damper 61, has a plate-like shape and is arranged to oppose an opening of the first communication path 25 on the fuel gallery 23 side. Thus, when fuel flows from the pressuring chamber 24 to the fuel gallery 23 (i.e., when pulsation occurs), the pressure of the fuel flowing backward is received by the flat first end portion 61*c*, rather than the accordion side walls or the like of the bellows damper 61. As a result, the pressure is efficiently reduced by the bellows damper 61 (i.e., the pulsation is also efficiently reduced).

The first end portion 61*c* which is the upper end side of the bellows damper 61 has hemispherical protrusions 61*e* in the first communication path 25 side. When the bellows damper 61 is in an expanded state (the accordion part is extended by fuel pulsation, and the first end portion 61*c* becomes closer to the first housing member 20*a*), the protrusions 61*e* are brought into contact with a surface of the first housing member 20*a* on the fuel gallery 23 side. This prevents the bellows damper 61 and the first housing member 20*a* from sticking on each other.

The sleeve 62 includes a tubular section 62*a*, and a ring-like section 62*b* extending radially outwardly from the lower end of the tubular section 62*a*.

The inner peripheral surface of the tubular section 62*a* fits the interior wall surface of the inner periphery side of the fuel gallery 23, and the outer peripheral surface is inserted in the bellows damper 61.

One surface of the ring-like section 62*b* at the tubular section 62*a* side is fixed to the second end portion 61*d* of the bellows damper 61 by welding or the like, and the surface on the opposite side of the tubular section 62*a* (surface on the opposite side of the surface fixed to the bellows damper 61) is fixed to an inner surface that is an end portion of the fuel gallery 23 of the second housing member 20*b* (see FIG. 1, the lower surface seen on the paper).

In a case of arranging the pulsation reducing mechanism 60, which has such a structure in the housing 20, it allows the bellows damper 61 to be joined to the sleeve 62, and the bellows damper 61 and the sleeve 62 to integrally fit the fuel gallery 23, before the first housing member 20*a* and the second housing member 20*b* are joined together. Note that the second housing member 20*b* and the sleeve 62 are fixed to each other by press fit.

Figure 3A:
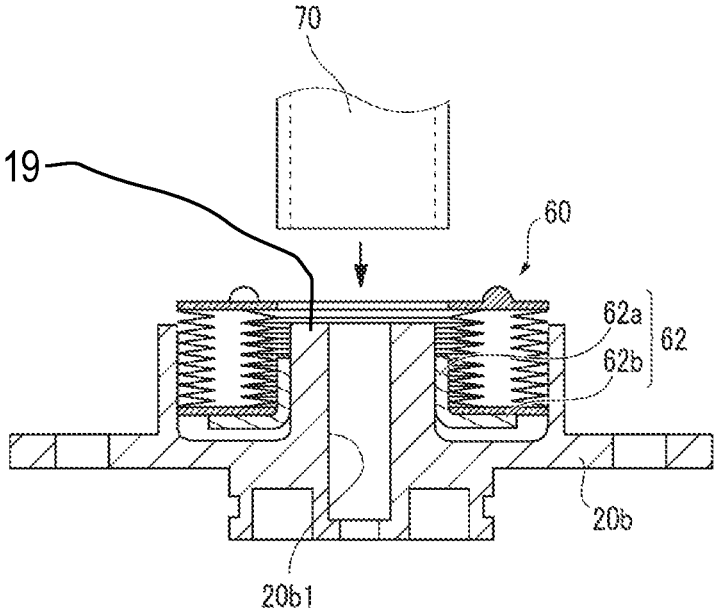
FIGS. 3A-3B schematically illustrate a way of installing a bellows damper to a second housing member when the fuel supply system in FIG. 1 is assembled, where

More specifically, as illustrated in FIG. 3A, first, the tubular section 62*a* of the sleeve 62, fixed to the bellows damper 61, is fit on to an upwardly extending cylindrical boss 19 which is integrally formed on, and extends upwardly from, the interior wall surface of the inner periphery side of the second housing member 20*b*.

Figure 3B:
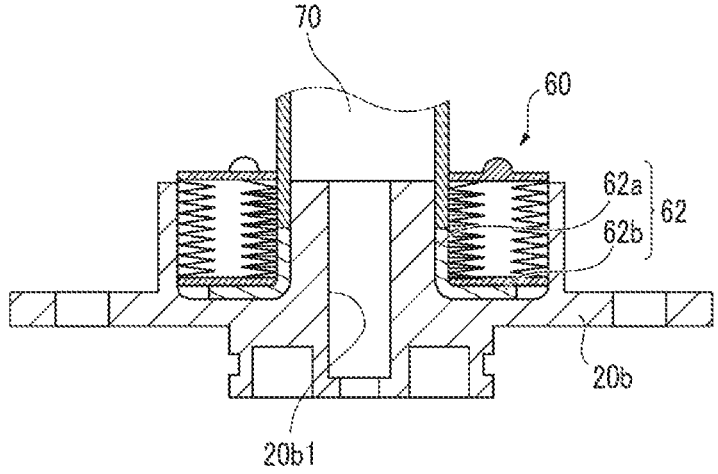

Next, as illustrated in FIG. 3B, the lower end surface of a press-fit punch 70 formed to be able to fit the interior wall surface to the inner periphery side of the second housing member 20*b*, is brought into contact with the upper end surface of the tubular section of the sleeve 62. Then, a press (not shown) connected to the upper side of the press-fit punch 70 presses the press-fit punch 70 and the sleeve 62 into the second housing member 20*b* to achieve an interference press fit, locking the sleeve in place on the upwardly extending cylindrical boss 19 of the second housing member.

Then, the plunger 10 is inserted in a hollow 20*b*1 formed inside of the upwardly extending cylindrical boss 19 of the second housing member 20*b*, and the first housing member 20*a* and the second housing member 20*b* are joined to each other.

Since the fuel supply system 1 achieves the press fit of the bellows damper 61 and the sleeve 62 by such a method, a gap to be fit by the press-fit punch 70 is provided between the second housing member 20*b*, and the bellows damper 61 and the sleeve 62.

More specifically, the length of the sleeve 62 in the axial direction is shorter than that of the bellows damper 61, and the inner diameter of the first end portion 61*c* of the bellows damper 61 and the inner diameter of the inner peripheral portion 61*b* are formed greater than the interior wall surface of the inner periphery side of the second housing member 20*b* by at least a thickness of the tubular section 62*a* of the sleeve 62.

Although the fuel supply system 1 has the bellows damper 61 attached to the second housing member 20*b* by the press fit described above, the way of installation is not limited to the press fit. For example, welding or other methods may also be used. Furthermore, the gap to be fit by the press-fit punch 70 between the second housing member 20*b*, and the bellows damper 61 and the sleeve 62 is formed for use of the tubular press-fit punch 70, and thus the gap may also be deformed or eliminated depending on the shape of installation tools.

Since the bellows damper 61 is installed in such a way, the bellows damper 61 is fixed to the side wall of the fuel gallery 23 via the sleeve 62. For this reason, positioning the bellows damper 61 (i.e., arranging the bellows damper 61 at the position that allows a sufficient reduction of pulsation caused by the reciprocating motion of the plunger 10) can be reliably performed. As a result, the bellows damper 61 can sufficiently carry out the pulsation reducing function. In addition, a misalignment of the axes of the tubular fuel gallery 23 and the tubular bellows damper 61 is avoided.

Therefore, the fuel supply system 1 can easily be assembled and has improved pulsation reducing efficiency.

Although the embodiment illustrated in the drawings has been described, the present invention is not limited to this embodiment.

For example, the housing 20 in the above-described embodiment is composed of two members: the first housing member 20*a* and the second housing member 20*b*. However, the housing of the present invention is not limited to this example, and may also be composed of three or more members as long as tubular chambers are separated from each other in the backward and forward movement direction of the plunger.

In the above-described embodiment, the bellows damper 61 fixed to the sleeve 62 is fixed to the second housing member 20*b* by bringing the sleeve 62, which is a fixing member, into contact with the inner periphery side and the end side (bottom side) of the tubular fuel gallery 23 of the second housing member 20*b* through which the plunger 10 passes. However, the fixing member of the present invention is not limited to this example. The fixing member may be fixed to the first housing member or fixed by being in contact with any one of the inner periphery side and the end side of the fuel gallery of the second housing. Alternatively, the fixing member may be eliminated and the damper may be directly fixed to the first housing member or the second housing member.

In the above-described embodiment, the ring-like section 62*b* of the sleeve 62 has a shape extending radially outwardly from the lower end portion of the tubular section 62*a*, and the tubular section 62*a* of the sleeve 62 (fixing member) is fit to the wall surface of the inner periphery side of the fuel gallery 23 (tubular chamber). However, the fixing member of the present invention is not limited to this example. For example, the ring-like section may have a shape extending radially inwardly from the lower end portion of the tubular section, and the tubular section may be fit to the wall surface of the outer periphery side of the tubular chamber.

In the above-described embodiment, the bellows damper 61 is used as a damper. However, the damper of the present invention is not limited to such a bellows damper, and may be any damper that can reduce pulsation in a liquid. For example, a damper configured by arranging an internal spring or the like may also be used.

In the above-described embodiment, the first communication path 25 providing communication between the internal space of the inflow amount restrictor 40 and the fuel gallery 23 extends in a direction along the direction which the bellows damper 61 expands or contracts. However, the fuel channel of the present invention is not limited to this example, and may also extend in a direction different from the damper expanding/contracting direction.

REFERENCE SIGNS LIST

1 fuel supply system
10 plunger
20 housing
20*a* first housing member
20*b* second housing member
20*b*1 hollow
21 inlet-side receiving hollow
22 outlet-side receiving hollow
23 fuel gallery (tubular chamber)
24 pressuring chamber
25 first communication path (fuel channel)
26 second communication path
27 third communication path
30 spring
40 inflow amount restrictor
41 electromagnetic valve
50 discharging member
51 check valve
60 pulsation reducing mechanism
61 bellows damper
61*a* outer peripheral portion
61*b* inner peripheral portion
61*c* first end portion
61*d* second end portion
61*e* protrusion
62 sleeve (fixing member)
62*a* tubular section
62*b* ring-like section

What is claimed is:

1. A fuel supply system comprising:

a plunger;

a housing with the plunger inserted therein so as to move backward and forward; and a pulsation reducing mechanism arranged in the housing, wherein the housing includes a tubular chamber provided so as to extend in a direction of the backward and forward movement of the plunger and surround an axis line of the plunger, and a pressuring chamber communicating with the tubular chamber, the tubular chamber being a space between an inner peripheral wall, which surrounds the axis line of the plunger and extends parallel to the axis line of the plunger, and an outer peripheral wall which surrounds the axis line of the plunger and extends parallel to the axis line of the plunger, the tubular chamber overlaps with a moving range of the plunger, in the direction of the backward and forward movement of the plunger, from a forward side end of the pressuring chamber arranged at a forward-movement side of the plunger to an end at a backward-movement side of the plunger when the plunger is moving backward, one end portion of the plunger moving backward from and forward into the pressuring chamber, the housing is formed by joining, at least, a first housing member forming one end side of the tubular chamber in the direction of the backward and forward movement of the plunger and a second housing member forming an other end side of the tubular chamber, and the pulsation reducing mechanism includes a tubular damper housed in the tubular chamber, wherein:

the tubular damper includes a space between an inner peripheral portion which surrounds the axis line of the plunger and an outer peripheral portion which surrounds the axis line of the plunger, the pulsation reducing mechanism includes a fixing member for fixing the damper to the first housing member or to the second housing member, the fixing member having a substantially L-shaped cross-sectional shape including a tubular section extending parallel to the axis line of the plunger, and a ring-like section extending radially outwardly from an end of the tubular section in a direction substantially perpendicular to the axis line of the plunger, the inner peripheral portion and the outer peripheral portion of the damper are both operatively connected to the ring-like section of the fixing member, and the tubular section is fixed to a surface of the inner peripheral wall or a surface of the outer peripheral wall by a press fit.

2. A fuel supply system comprising:

a plunger;

a housing with the plunger inserted therein so as to move backward and forward; and a pulsation reducing mechanism arranged in the housing, wherein the housing includes a tubular chamber provided so as to extend in a direction of the backward and forward movement of the plunger and surround an axis line of the plunger, and a pressuring chamber communicating with the tubular chamber, the tubular chamber being a space between an inner peripheral wall, which surrounds the axis line of the plunger and extends parallel to the axis line of the plunger, and an outer peripheral wall which surrounds the axis line of the plunger and extends parallel to the axis line of the plunger, the tubular chamber overlaps with a moving range of the plunger, in the direction of the backward and forward movement of the plunger, from a forward side end of the pressuring chamber arranged at a forward-movement side of the plunger to an end at a backward-movement side of the plunger when the plunger is moving backward, one end portion of the plunger moving backward from and forward into the pressuring chamber, the housing is formed by joining, at least, a first housing member forming one end side of the tubular chamber in the direction of the backward and forward movement of the plunger and a second housing member forming an other end side of the tubular chamber, and the pulsation reducing mechanism includes a tubular damper housed in the tubular chamber, wherein:

the tubular damper includes a space between an inner peripheral portion which surrounds the axis line of the plunger and an outer peripheral portion which surrounds the axis line of the plunger, the damper is a bellows damper expanding or contracting in the direction of the backward and forward movement of the plunger, the bellows damper includes an inner wall portion and an outer wall portion, the inner wall portion includes tubular mountain folds and tubular valley folds alternately in relation to a center line direction, and the outer wall portion includes tubular mountain folds and tubular valley folds alternately in relation to the center line direction.

3. The fuel supply system according to claim 2, wherein the housing further includes a fuel channel providing communication between the pressuring chamber and the tubular chamber, and the fuel channel is formed to extend in a direction along a direction of an expanding or contracting of the damper.

4. A bellows damper for a fuel supply system, the fuel supply system including a plunger and a housing with the plunger inserted therein so as to move backward and forward, the bellows damper being arranged inside the housing, the housing including a tubular chamber composed of a tubular space provided so as to extend in a direction of the backward and forward movement of the plunger, and a pressuring chamber communicating with the tubular chamber, one end portion of the plunger moving backward from and forward into the pressuring chamber, the bellows damper comprising:

a tubular outer peripheral portion formed of an accordion metal thin layer;

a tubular inner peripheral portion provided on an inner peripheral side of the tubular outer peripheral portion and formed of an accordion metal thin layer;

a ring-like first end portion provided on one end side of the tubular outer peripheral portion and the tubular inner peripheral portion; and a ring-like second end portion provided on the other end side of the tubular outer peripheral portion and the tubular inner peripheral portion;

wherein the ring-like second end portion is fixed to an end portion of the tubular chamber, and the ring-like first end portion is provided with hemispherical protrusions at an opposite side of the ring-like second end portion.

5. The bellows damper for the fuel supply system according to claim 4, wherein the ring-like first end portion and the ring-like second end portion are formed flat like a plate.

6. The bellows damper for the fuel supply system according to claim 4, wherein the housing includes a fuel channel providing communication between the pressuring chamber and the tubular chamber, and the ring-like first end portion is arranged so as to oppose an opening of the fuel channel on a tubular chamber side.

7. The bellows damper for the fuel supply system according to claim 4, further comprising a fixing member composed of, a tubular section which fits an inner peripheral surface of the tubular chamber and which is inserted into the tubular inner peripheral portion, and a ring-like section extending radially outwardly from an end portion of the tubular section, wherein the ring-like second end portion is fixed to a surface of the ring-like section at a tubular section side by welding, and a surface of the ring-like section on an opposite side of the tubular section is fixed to an inner surface which is an end portion of the tubular chamber.

8. A bellows damper for a fuel supply system, the fuel supply system including a plunger and a housing with the plunger inserted therein so as to move backward and forward, the bellows damper being arranged inside the housing, the housing including a tubular chamber composed of a tubular space provided so as to extend in a direction of the backward and forward movement of the plunger, and a pressuring chamber communicating with the tubular chamber, one end portion of the plunger moving backward from and forward into the pressuring chamber, the bellows damper comprising:

a tubular outer peripheral portion formed of an accordion metal thin layer;

a tubular inner peripheral portion provided on an inner peripheral side of the tubular outer peripheral portion and formed of an accordion metal thin layer;

a ring-like first end portion provided on one end side of the tubular outer peripheral portion and the tubular inner peripheral portion; and a ring-like second end portion provided on the other end side of the tubular outer peripheral portion and the tubular inner peripheral portion;

wherein the damper expands and contracts in a direction along the direction of the backward and forward movement of the plunger.

* * * * *